US006761094B2

(12) United States Patent
Tobako

(10) Patent No.: US 6,761,094 B2
(45) Date of Patent: Jul. 13, 2004

(54) HANDLE FOR HAND TOOL

(76) Inventor: John Tobako, 22734 Amazon St., Stacy, MN (US) 55079

( * ) Notice: Subject to any disclaimer, the term of this patent is extended or adjusted under 35 U.S.C. 154(b) by 189 days.

(21) Appl. No.: 09/932,543

(22) Filed: Aug. 20, 2001

(65) Prior Publication Data

US 2003/0188606 A1 Oct. 9, 2003

(51) Int. Cl.[7] ..... B25B 23/16
(52) U.S. Cl. ..... 81/177.2; 403/109; 403/328
(58) Field of Search ..... 81/177.2; 403/324–328, 403/107–109

(56) References Cited

U.S. PATENT DOCUMENTS 2,869,410 A * 1/1959 Prichard ..... 81/177.2
3,227,015 A * 1/1966 Tremblay ..... 81/177.2
5,109,737 A * 5/1992 Raber ..... 81/177.2

* cited by examiner

*Primary Examiner*—D. S. Meislin
(74) *Attorney, Agent, or Firm*—Angenehm Law Firm, Ltd; N Paul Friederichs

(57) ABSTRACT

A hand tool, including a shank having a proximal end joined to an operational head, the shank including an elongated groove with corresponding ends adjacent the proximal end and a distal end of the shank; a slidably sleeve sized to receive the shank, the sleeve defining a set aperture; a set disposed in the set aperture and positioned to bias into the elongated groove, the set preventing sliding between the shank and sleeve when tightened and the set allowing sliding between the shank and the sleeve when loosened; and a selective lock relating between the sleeve and the shank, the lock preventing separation of the sleeve and the shank when the sleeve and shank are in rotational alignment, the lock allowing separation of the sleeve and the shank when the sleeve and shank are out of rotational alignment.

12 Claims, 2 Drawing Sheets

HANDLE FOR HAND TOOL

FIELD OF THE INVENTION

The present invention relates to hand tools and more particularly to hand tools with extendable handles for increasing leverage.

BACKGROUND OF THE INVENTION

Hand tools, such as wrenches, are known and commonly used by mechanics, the construction trade, other professionals and the common person for use around the home. The tools generally include at least one operational head, a shank, which may function as a handle, and perhaps a portion specifically designed as a handle. The longer the shank the more torque that can be applied to the nut, bolt screw or other fastener. Still, the tools are often used with tight confines that limit the overall length of the tool. This has led to the tools having lengths that range from a couple inches to several feet in length.

Some inventions have developed that provide for shanks of adjustable length. For instance, U.S. Pat. No. 2,438,633 to Condor, entitled Extensible Tool Shank, discloses an hand tool with an extendable handle with a plurality of preset lengths determining the lengths to which the tool may be adjusted. Others such as U.S. Pat. No. 2,869,410 to Prichard, entitled Reversible Ratchet Wrench with Handle Extension Means, disclose a handle that may be extended along the shank of a tool. Unfortunately, handles are made much shorter than the shank, which limits the range of extension of the tool without enlarging the handle and losing the function of the handle in terms of placement and comfort of the hand.

Still others have tried telescoping handles such as U.S. Pat. No. 4,307,634 to Gentry. Hollow handles are weak and easily bent in situations of increased torque, especially where the external diameter of the shank becomes narrow. Moreover, the shank receives concentrated pressure adjacent the operational head where the narrowest portions of the telescope are situated.

When moving parts are found in tools dirt and grime can collect in crevices interfering with normal operation. Life span of adjustable tools is often determined in terms of how long the dirt can be kept out of the crevices and how easily such dirt and grime can be removed. Few if any existing tools allow thorough cleaning of the components.

What is needed is an extendable shank that may be locked at any length throughout a range as opposed to specific lengths. Further, the shank should not be telescoping with easily bent hollow segments. The shank should be arranged in such a manner as to allow a near doubling of the length of the shaft. Desirably, the shank adjacent the operational head is solid metal adding strength where strength is needed. Further, the sleeve and shank should easily separate for easily cleaning of the components from dirt and grime. Yet, the tool should be designed to avoid unintentional separation of the components. These needs and other useful features are found in the below described invention.

SUMMARY

A hand tool includes a shank with a proximal end joined to an operational head. The shank includes an elongated groove with corresponding ends adjacent the proximal end and a distal end of the shank. A slidable sleeve has an internal channel with the sleeve sized to receive the shank. The sleeve defines a set aperture.

A set is disposed in the set aperture and is positioned to bias into the elongated groove on the shank. The set prevents sliding between the shank and sleeve when tightened and allows sliding between the shank and the sleeve when the set is loosened.

A selective lock relates between the sleeve and the shank. The lock prevents separation of the sleeve and the shank when the sleeve and shank are in rotational alignment. The lock allows separation of the sleeve and the shank when the sleeve and shank are out of rotational alignment.

The selective lock may include a bore which houses a spring and a ball and which correspond with a snap hole. The device may include a plurality of selective locks such as a proximal selective lock and a distal selective lock.

Advantageously, this invention provides for easy separation of the sleeve and shank to allow dirt and grime to be cleaned from the components.

As a further advantage, the shank is joined to the operational head and the sleeve adjusts away from the shank, which allows the shank to be made solid, adding strength at the surgical neck of the tool.

As yet another advantage the tool is provided with selective locks holds the sleeve or handle in the fully extended position and the fully retracted position.

As yet another advantage, the tools is provided with a set that allows the sleeve to be selectively locked relative to the shank, allowing the tool to remain a fixed length until change is desired.

As still yet another advantage, the set is positioned in a groove to preclude unintentional easy separation of the sleeve from the shank.

Also advantageously, the present invention provides sufficient clearance between the sleeve and shank to avoid the need for sticky dirt collecting lubricant, yet remain small enough to avoid dirt and grime from entering the tool.

Also an advantage is when the lock screw is left loose the extension handle may be moved in and out during the tightening and loosening of a fastener in the same stroke, allowing more torque to start rotation and reduce handle length for speed and to clear handle swing in close confined spaces.

These and other advantages will be found in the description of the invention below.

DETAILED DESCRIPTION

Figure 1:
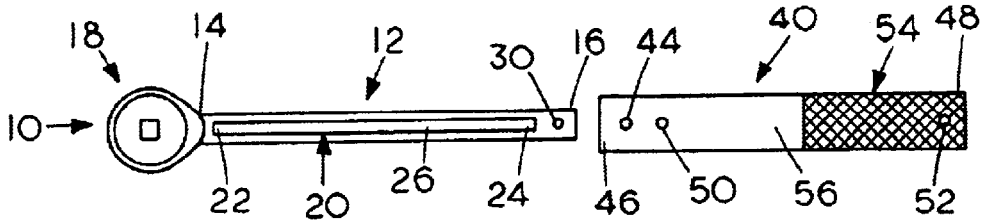
FIG. 1 is a bottom view showing the shank and sleeve separated.
Figure 2:
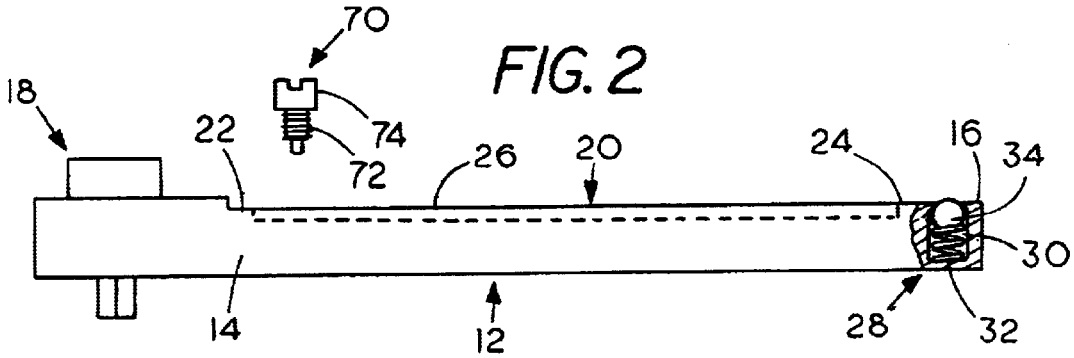
FIG. 2 is a side view of the shank, showing the selective lock in phantom.
Figure 3:
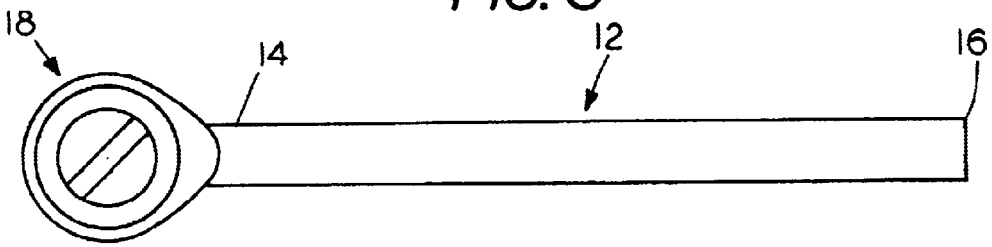
FIG. 3 is a top view of the shank.
Figure 4:
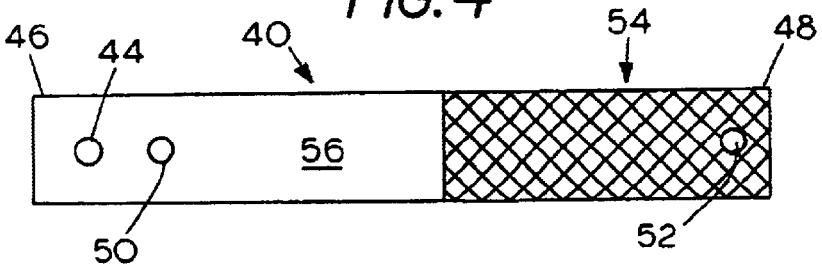
FIG. 4 is a bottom view of the sleeve.
Figure 5:
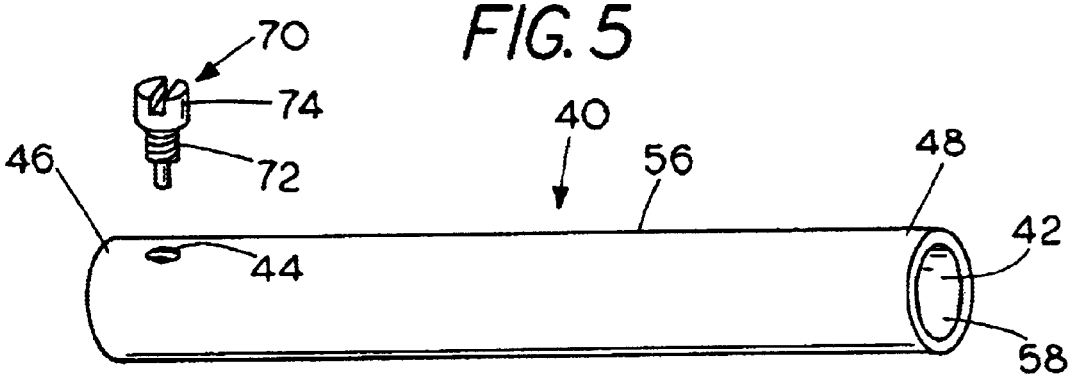
FIG. 5 is the side view of the sleeve together with the set screw.
Figure 6:
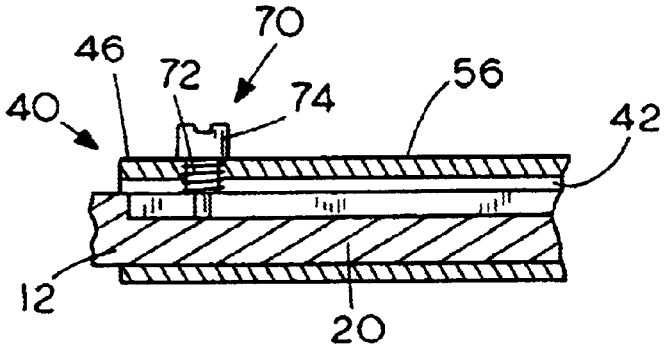
FIG. 6 is a side view in partial cross section of the sleeve and set screw.
Figure 7:
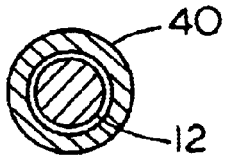
FIG. 7 is a cross sectional view showing the sleeve circumscribing the shaft.

A hand tool 10 is shown in FIGS. 1 through 3 to include a shank 12 having a proximal end 14 joined, perhaps integrally, to an operational head 18. The operational head 18 may be a head for a socket set, an open or boxed end wrench, a breaker bar, a sliding "T" handle, an adjustable wrench head or other head now or latter used in the field of tools. Preferably, the tool 10 is formed of hardened steel.

The shank 12 includes an elongated groove 20 with corresponding proximal and distal ends 22, 24 adjacent the proximal end 14 and a distal end 16 of the shank 12 respectively. The groove 20 may be disposed on a lower surface 26 of the shank 12, but, not necessarily, any position around the circumference will do. Lower surface 26 is intended to mean the portion of the shank 12 that is facing away from a user when the user is using the hand tool 10 in a typical manner.

A slidable sleeve 40, shown in FIGS. 1, and 4 through 6, has an internal channel 42. Sleeve 40 may have knurling 54, rubber coating, or other mechanism for improved gripping now known or later developed. The sleeve 40 is sized to receive the shank 12. The sleeve 40 and the shank 12 preferably have a clearance sufficient to avoid the need for lubricant yet small enough to minimize dirt uptake. The sleeve 40 and the shank 12 in the preferred mode have a clearance of approximately 0.005/0.010 inches. The sleeve 40 defines a set aperture 44, which preferably a set aperture, but may be desired for a set, which is not a screw. The sleeve 40 defines an aperture 58 at the proximal end 46 providing an entrance into the internal channel 42 and the sleeve 40 may be, but, not necessarily, solid at the distal end 48. The proximal end portion 46 of the sleeve may define a proximal snap hole 50 and the distal end portion 48 of the sleeve 40 defining a distal snap hole 52. With heavier will thickness of sleeve 40 additional snap holes in line with proximal snap hole 50 and distal snap hole 52 may be used for variation in sleeve 40 adjusted length.

A set 70, which preferably is a screw, but may be a tab, detent or other form of set, is disposed in the set aperture 44 and positioned to bias into the elongate groove 20. The set 70 may prevent rotation between the shank 12 and sleeve 40 when tightened, e.g. when the operational end 74 is turned sufficiently to cause a connection between the engaging end 72 of the set and the shank 12 inside the groove 20. The set 70 allows sliding between the shank 12 and the sleeve 40 when loosened sufficiently to break the connection between the engaging end 72 and the shank 12. This also may be left loose intentionally as an alternate form of normal operation. A close tolerance Class #3 screw fit between engaging end 72 and set aperture 44 may insure unintentional rotation of set 70 in the loose mode. Set 70 prevents rotation of the sleeve 40 relative to the shank 12. When the set projects into the groove 20 it also acts as a stop when the handle 40 is extended and set 70 contacts the groove 20 distal end 24. When sleeve 40 does not have a closed end 48, set 70 acts as a stop when handle 40 is pushed into it's smallest length, and distal end 22 is contacted by set 70. It is held in closed position by selective lock 28.

A selective lock 28 relates between the sleeve 40 and the shank 12. The lock 28 prevents separation of the sleeve 40 and the shank 12 when the sleeve 40 and shank 12 are in rotational alignment. The lock 28 allows separation of the sleeve 40 and the shank 12 when the sleeve 40 and shank 12 are out of rotational alignment. Preferably the tool 10 has a plurality of selective locks 28.

The selective lock 28 may include a bore 30, which houses a spring 32 and a ball 34 and which cooperates with a snap hole 50 or 52, not to preclude the possibility of other snap holes in line with the two disclosed snap holes 50, 52. A detent or similar structure now known or later developed may be used as the selective lock 28. The bore 30 is defined adjacent the distal end 48 of the shank 12. The bore 30 houses the spring 32 and the ball 34. The spring 32 directs the ball 34 into the proximal snap hole 50 when the sleeve 40 is fully extended from the shank 12. The spring 32 directs the ball 34 into the distal snap hole 52 when the sleeve 40 is fully contracted relative to the shank 12. The proximal and distal snap holes 50, 52 may be on a lower surface 56 of the sleeve 40. Lower surface 56 is intended to mean the portion of the sleeve 40 that is facing away from a user when the user is using the hand tool 10 in a typical manner. This does not preclude that a snap hole (not shown) could be placed at any position around the circumference, co-joining the spring and ball.

The shank 12 and the sleeve 40 separate when the set 70 is fully loosened and the sleeve 40 is fully extended from the shank 12, while the shank 12 and sleeve 40 are out of rotational alignment, e.g., when the proximal or distal snap holes 50, 52 are laterally offset from the bore 30. This avoids the selective lock 28 from engaging and allows the sleeve 40 to be removed from the shank 12. The set 70 holds the shank 12 and sleeve 40 in rotational alignment when the set 70 extends at least partially into the groove 20.

In operation, the user loosens the set 70 via twisting the operational end 74, releasing the contact between the engaging end 72 of the set 70 and the shank 12. The sleeve 40 may then be moved relative to the shank 12 to shorten or lengthen the profile of the tool 10. A longer profile increases leverage, while a shorter profile allows the user to work in tight confines. Once the desired length is achieved, the set 70 is tightened creating contact between the engaging end 72 of the set 70 and the shank 12, thus selectively locking the sleeve 40 relative to the shank 12. Alternately, set 70 may be left loose enabling the sleeve 40 to slide to and fro freely on shank while still engaging groove 26 to prevent twisting of sleeve 40. This operational format allows the user to have greater freedom of rapid motion elongating for high torque needs and sliding in for rapid removal of bolts or nuts. Selective locks 28 aid in retaining the sleeve 40 fully extended of fully retracted, and the use of a line of snap holes between snap holes 50 and 52 would add intermittent snap locking settings without the necessity of tightening set 70.

The sleeve 40 may be easily separated from the shank 12 to clean out dirt and grime. The user simply loosens the set 70 such that it does not extend into the groove 20. The sleeve 40 is rotated relative to the shank 12 moving the ball 34 out of alignment with the aperture of the sleeve 40. The sleeve 40 may then be removed from the shank 12 for cleaning of the parts.

Although the present invention has been described with reference to preferred embodiments, workers skilled in the art will recognize changes may be made in form and detail without departing from the spirit and scope of the invention.

I claim:

1. A hand tool, comprising:

a shank having a proximal end joined to an operational head, the shank including an elongated groove;

a slidable sleeve having an internal channel, the sleeve sized to receive the shank, the sleeve defining a set aperture;

a set disposed in the set aperture and positioned to bias into the elongated groove, the set preventing sliding between the shank and sleeve when tightened and the set allowing sliding between the shank and the sleeve when loosened; and a selective lock relating between the sleeve and the shank, the lock preventing separation of the sleeve and the shank when the sleeve and shank are in rotational alignment, the lock allowing separation of the sleeve and the shank when the sleeve and shank are out of rotational alignment.

2. The device of claim 1 wherein the sleeve has knurling.

3. The device of claim 1 wherein the groove is disposed on a lower surface of the shank.

4. The device of claim 1 wherein the shank and the sleeve separate when the set is fully loosened, and the sleeve is fully extended from the shank while the shank and sleeve are out of rotational alignment.

5. The device of claim 1 wherein the set holds the shank and sleeve in rotational alignment when the set extends at least partially into the groove.

6. The device of claim 1 wherein the sleeve defines an aperture at the proximal end providing an entrance into the internal channel and the sleeve is solid at the distal end.

7. The device of claim 1 wherein the sleeve and the shank have a clearance sufficient to avoid the need for lubricant yet small enough to minimize dirt uptake.

8. The device of claim 7 wherein the sleeve and the shank have a clearance in the range of 0.005 to 0.010 inches.

9. The device of claim 1 wherein the selective lock includes a bore housing a spring and a ball which cooperate with a snap hole.

10. The device of claim 1 including a plurality of selective locks.

11. The device of claim 10 including a proximal selective lock and a distal selective lock.

12. The device of claim 1 formed of hardened steel.

* * * * *